US008857094B2

(12) United States Patent
Michel

(10) Patent No.: US 8,857,094 B2
(45) Date of Patent: Oct. 14, 2014

(54) DUAL POSITION FIREARM GRIP

(76) Inventor: Daniel Michel, Diamond Bar, CA (US)

( * ) Notice: Subject to any disclaimer, the term of this patent is extended or adjusted under 35 U.S.C. 154(b) by 251 days.

(21) Appl. No.: 13/418,408

(22) Filed: Mar. 13, 2012

(65) Prior Publication Data

US 2013/0239450 A1 Sep. 19, 2013

(51) Int. Cl.
*F41C 23/00* (2006.01)

(52) U.S. Cl.
USPC ..... 42/73; 42/71.01; 42/72; 89/1.42

(58) Field of Classification Search
USPC ..... 42/71.02–73; 89/1.42
See application file for complete search history.

(56) References Cited

U.S. PATENT DOCUMENTS

| | | | | |
|---|---|---|---|---|
| 2009/0313873 | A1* | 12/2009 | Roth | 42/72 |
| 2012/0272557 | A1* | 11/2012 | Yan | 42/69.01 |
| 2013/0036645 | A1* | 2/2013 | Chvala | 42/73 |
| 2013/0097911 | A1* | 4/2013 | Larue | 42/73 |
| 2013/0333263 | A1* | 12/2013 | Hovey | 42/72 |
| 2013/0340312 | A1* | 12/2013 | Fulton et al. | 42/73 |

* cited by examiner

*Primary Examiner* — Michelle R Clement
(74) *Attorney, Agent, or Firm* — Schwegman Lundberg & Woessner, P.A.

(57) ABSTRACT

A grip for an elongated fire arm has an adapter, a handle, and a spring loaded screw, bolt, and nut. The adapter has a top portion and a bottom portion. The top portion receives a lower receiver of a rifle. The bottom portion has at least two locking tabs adjacent to a base of a shaft extending from the bottom portion of the adapter. The handle has a cavity disposed in an upper portion to mate with the shaft, and at least two pockets adjacent to the cavity to mate with the at least two locking tabs. The handle is rotatable about an axis of the shaft when the at least two pockets are disengaged from the at least two locking tabs.

9 Claims, 7 Drawing Sheets

DUAL POSITION FIREARM GRIP

TECHNICAL FIELD

The present application relates generally to a grip configuration, and in a specific example embodiment, a dual position arm grip that allows the carrier to ergonomically hold a weapon comfortably for sustained periods of time, which may prove to prevent wrist, hand or arm injury.

BACKGROUND

Conventional grips for rifles are positioned in an angled back position (also referred to as a "palm swell position"). The angled back position of the rifle grip is based on soldiers holding their rifle in a shooting position. However, on duty soldiers while on patrol typically hold their rifle with the muzzle pointed to the ground for long periods of time, thereby causing pain and discomfort to their wrists.

BRIEF DESCRIPTION OF THE DRAWINGS

The present invention is illustrated by way of example, and not by way of limitation, in the figures of the accompanying drawings in which.

DETAILED DESCRIPTION

Embodiments of the present invention are described herein in the context of a power connection structure. Those of ordinary skill in the art will realize that the following detailed description of the present invention is illustrative only and is not intended to be in any way limiting. Other embodiments of the present invention will readily suggest themselves to such skilled persons having the benefit of this disclosure. Reference will now be made in detail to implementations of the present invention as illustrated in the accompanying drawings. The same reference indicators will be used throughout the drawings and the following detailed description to refer to the same or like parts.

A rifle grip is described herein. The rifle grip has an adapter, a handle, and a spring loaded screw. The adapter has a top portion and a bottom portion. The top portion receives a lower receiver of a rifle. The bottom portion has at least two locking tabs adjacent to a base of a shaft extending from the bottom portion of the adapter. The handle has a cavity disposed in an upper portion to mate with the shaft, and at least two pockets adjacent to the cavity to mate with the at least two locking tabs. The handle is rotatable about an axis of the shaft when the at least two pockets are disengaged from the at least two locking tabs. The spring loaded screw secures the handle against the adapter. The at least two pockets of the handle are engaged against the at least two locking tabs of the adapter in a first state of the spring loaded screw. The handle is rotatable about the axis of the shaft in a second state of the spring loaded screw.

In one embodiment, a grip for a fire arm is described in the present application. For example, the grip may be suitable for a fire arm such as a rifle or any other elongated fire arm. In another embodiment, the grip presently described may be suitable for use in other applications, such as a hand held telescopic grip, or another other devices or apparatuses having an elongated body coupled to a grip or handle. The devices may be held in a vertical position for long periods of time by a user via the grip.

The ability to rotate the handle from one angled position to another angled position greatly improves comfort and alleviates repetitive use injuries. Furthermore, the present grip provides the ability to change from one angled position to another angled position without having to manually remove a grip having a first angled position from a rifle, and reattach another grip having a second angled position to the rifle.

In one application, soldiers will greatly appreciate the ability to have a "vertical" position of their grip while on duty in the "ready" position of holding the rifle while pointing the muzzle to the ground. The soldiers can later switch the position of the grip back to the regular angled back position (also referred to as "palm swell position") quickly without having to unmount and mount another grip.

Figure 1B:
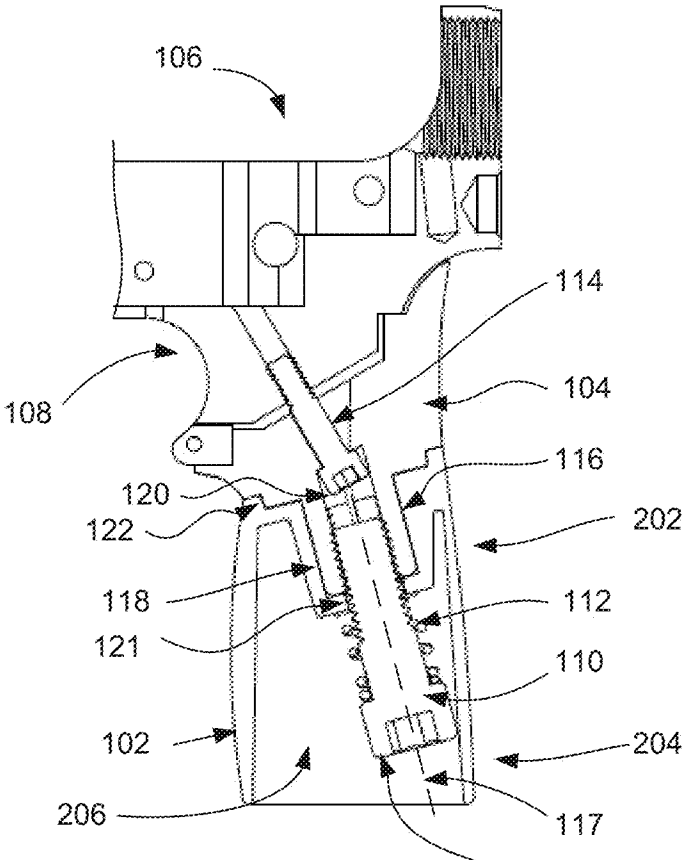
FIG. 1B is a schematic diagram showing a cross-sectional side view of an example embodiment of the grip in the first locked position.
Figure 1A:
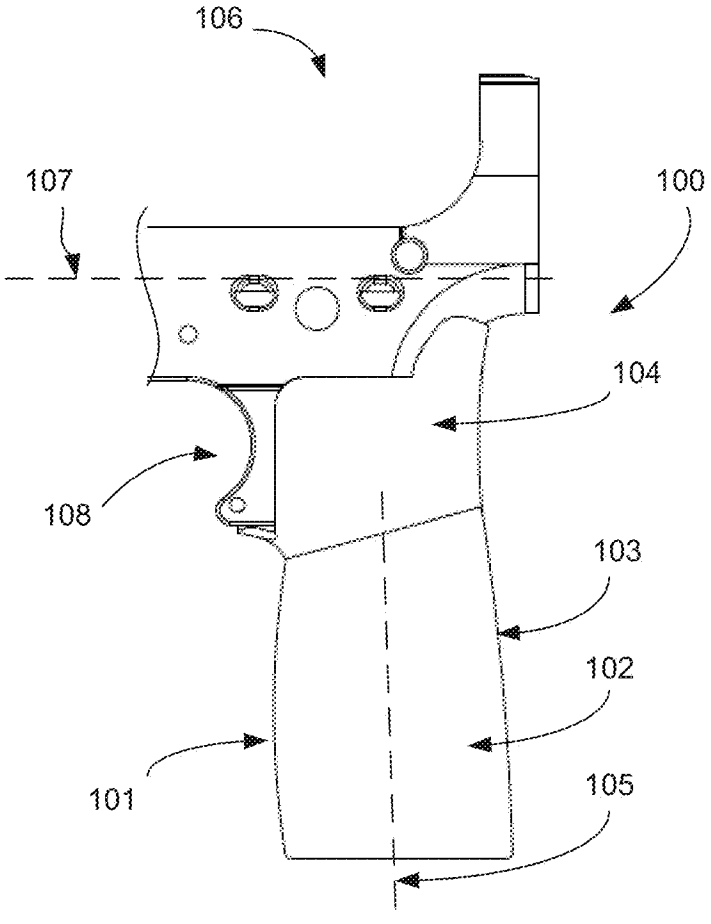
FIG. 1A is a schematic diagram showing a side view of an example embodiment of a grip in a first locked position.

FIG. 1A is a schematic diagram showing a side view of an example embodiment of a grip 100 in a first locked position. An adapter 104 is attached to a portion of the rifle 106 adjacent to a trigger part 108. A handle 102 is connected to the adapter 104. In this first locked position, a user would position the palm of their hand on the handle 102 with their index finger ready on the trigger part 108. It should be noted that in the first locked position as illustrated in FIG. 1A, a back wall 103 and a front wall 103 of the handle 102 are substantially perpendicular to an axis 107 of the rifle 106. In other words, the vertical axis 105 of the handle 102 is substantially perpendicular to the axis 107 of a barrel of the rifle 106.

In one embodiment, the position of the handle in reference to the rifle 106 is such that the amount of stress on a user's wrist would be minimized when the user is holding the rifle pointed straight towards the ground.

In one embodiment, the handle 102 may be configured to be mounted on a tripod. In such case, the bottom portion of the handle 102 may include a physical configuration compatible to receive the tripod.

FIG. 1B is a schematic diagram showing a cross-sectional side view of an example embodiment of the grip 100 in the first locked position. A screw 114 secures the adapter 104 to a part of the rifle 106 (for example, a lower receiver) next to the trigger part 108. The adapter 104 includes a swivel stem, such as a shaft 116 extending from a bottom of the adapter 104. The shaft 116 mates with a cavity 118 of the handle 102.

The handle 102 has an upper portion 202 and a lower portion 204. The upper portion 202 comprises the cavity 118 for receiving the shaft 116. The lower portion 204 comprises a cavity 206. In one embodiment, the cavities 118 and 206 are connected through an aperture 121.

A spring loaded screw 109 secures the handle 102 against the adapter 104. The spring loaded screw 109 comprises a screw 110 and a spring 112. The screw 110 mates with the opening 120 of the shaft 116 through the aperture 121 at the end of the cavity 118. The spring 112 is disposed between the screw 110 and the aperture 121. The adapter 104 includes locking tabs 122 at the base of the shaft 116. The locking tabs 122 prevent the handle 102 from rotating or swiveling about an axis 117 of the shaft 116.

In another embodiment, the handle 102 may be secured and engaged with the shaft 116 of the adapter 104 via other means such as one or more screws, bolts, nuts, etc. For example, the handle may be removed from the adapter 104 by loosening the screw, removing the screw, rotating the handle 102, and reassembling the screw. Other means of securing the handle 102 with the adapter 104 include squeezing the handle 102 the shaft of the adapter 104 to lock the handle 102. In other words, the handle 102 may behave like a hose clamp.

In one embodiment, the adapter 104 includes two locking tabs 122 opposite to one another at a base of the shaft 116. In another embodiment, the adapter 104 may include more than one locking tabs 122 at the base of the shaft 116. The locking tabs 122 may be disposed anywhere at a bottom surface of the adapter 104 adjacent to the shaft 116 so that the locking tabs 122 mate with corresponding pockets 123 formed in a top surface of the handle 102.

In another embodiment, the locking tabs 122 may include notches, nodes, or bumps to prevent a rotational movement of the handle 102 when corresponding pockets 123 from the handle 102 mate with the locking tabs 122.

In yet another embodiment, pegs and/or spring loaded detents may be used to lock the position of the handle 102.

Figure 2B:
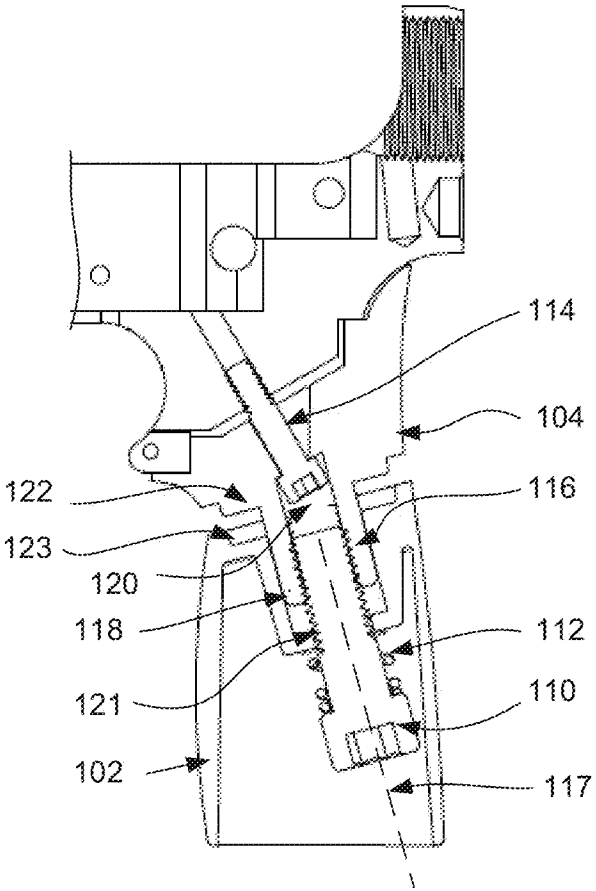
FIG. 2B is a schematic diagram showing a cross-sectional side view of an example embodiment of the grip disengaged in the first locked position.
Figure 2A:
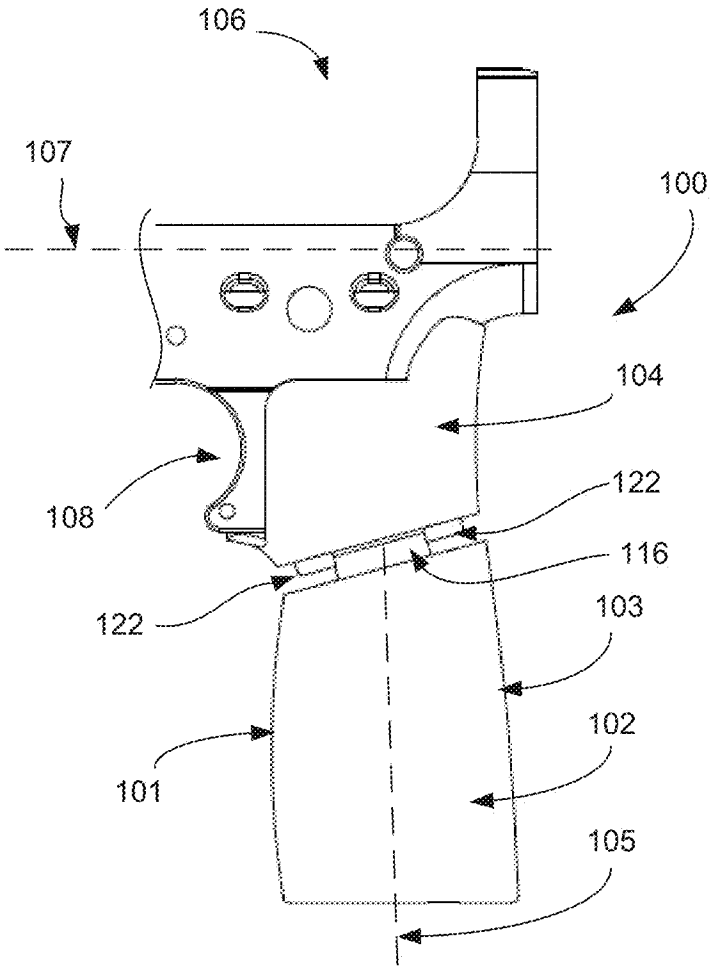
FIG. 2A is a schematic diagram showing a side view of an example embodiment of the grip disengaged in a first locked position.

FIG. 2A is a schematic diagram showing a side view of an example embodiment of the grip 100 disengaged in a first locked position. The handle 102 is disengaged from the adapter 104. In one embodiment, the handle 102 remains coupled to the adapter 104 to the shaft 116 of the adapter 104. One way of temporarily disengaging the handle 102 from adapter 104 is to pull the handle 102 away from the adapter 104 along the axis 105 of the handle 102 thereby exposing the locking tabs 122.

In another embodiment, the handle 102 can be unlocked and slid out completely. The handle 102 can then be turned around, re-inserted back on the shaft 116, and locked via a locking mechanism. Because the handle 102 can be completely slid out, the shape of the shaft may include different shapes in addition to a round shape including but not limited to elliptical, square, rectangular, and others.

FIG. 2B is a schematic diagram showing a cross-sectional side view of an example embodiment of the grip 100 disengaged in the first locked position. The spring 112 is in a further compressed state when the handle 102 is pulled away from the adapter 104. In other words, the spring 112 is more compressed in FIG. 2B than in FIG. 1B. The handle 102 moves along the axis 117 of the shaft 116 thereby pushing against the spring 112 disposed between the handle 102 and the screw 110.

The locking tabs 122 are disengaged from their respective pockets 123 of the handle 102 and thus do no longer prevent the handle 102 from rotating about the axis 117 of the shaft 116.

In one embodiment, the pockets 123 include tapered edges for receiving the locking tabs 122. In addition, the locking tabs 122 may include tapered edges for easier mating with the pockets 123.

In another embodiment, the adapter 104 may include multiple locking tabs 122 and the handle 102 may include multiple pockets 123 corresponding to the multiple locking tabs 122.

Figure 3B:
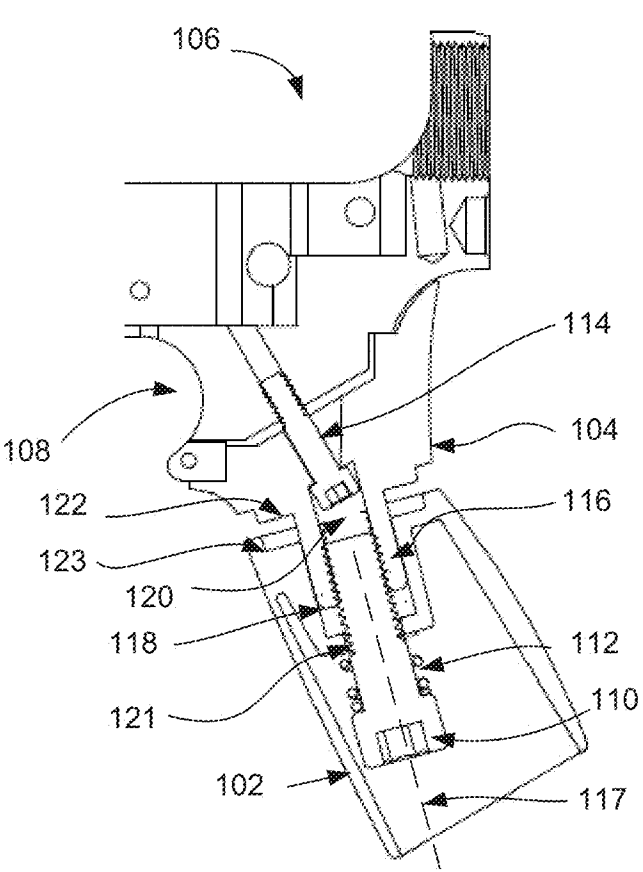
FIG. 3B is a schematic diagram showing a cross-sectional side view of an example embodiment of the grip disengaged in the second locked position.
Figure 3A:
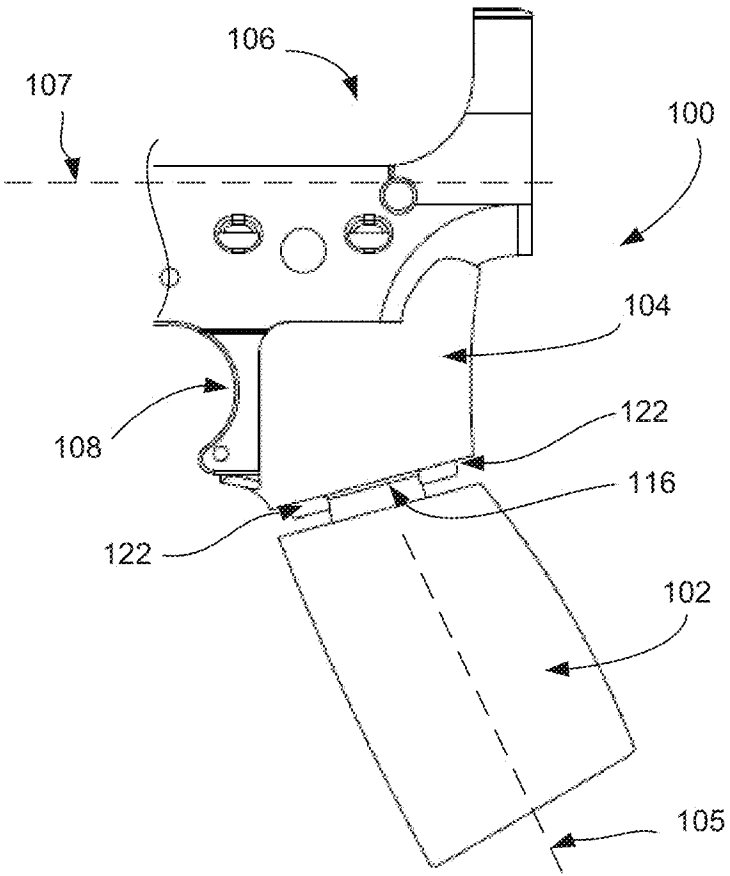
FIG. 3A is a schematic diagram showing a side view of an example embodiment of the grip disengaged in a second locked position.

FIG. 3A is a schematic diagram showing a side view of an example embodiment of the grip 100 disengaged in a second locked position. In one embodiment, FIG. 3A illustrates the second locked position after a 180° turn from the first locked position as illustrated in FIG. 2A. In other words, the handle 102 has rotated 180° about the axis 117 of the shaft 116. Because the axis 105 of the handle 102 intersects the axis 117 of the shaft 116 to form an angle. The angle may be formed between the axis 105 of the handle 102 and the axis of a barrel of the rifle 106 has changed. In one embodiment, the axis 105 of the handle 102 forms an obtuse or acute angle relative to the axis 107 of the barrel of the rifle 106. The angle illustrated in FIG. 3A is an ergonomic angle for a user operating the rifle 106 in a target practice mode or shooting mode, also referred to as a "palm swell" position. In one embodiment, multiple lower handles may be provided as part of a kit that offers many other angles in addition to the angles illustrated in FIGS. 1A, and 4A.

FIG. 3B is a schematic diagram showing a cross-sectional side view of an example embodiment of the grip 100 disengaged in the second locked position. The spring 112 is in a further compressed state when the handle 102 is pulled away from the adapter 104. In other words, the spring 112 is more compressed in FIG. 2B than in FIG. 1B. The handle 102 moves along an axis of the shaft 116 thereby pushing against the spring 112 disposed between the handle 102 and the screw 110. The locking tabs 122 are disengaged from their respective pockets 123 of the handle 102 and exposed. Because the locking tabs 122 no longer mate with their respective pockets 123, the handle 102 is free to swivel about the axis 117 of the shaft 116.

Figure 4B:
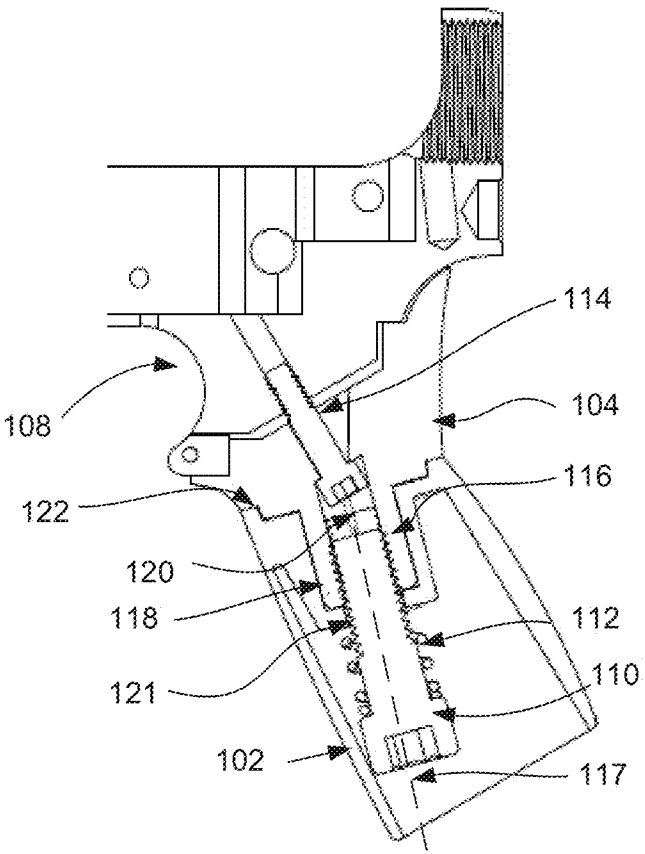
FIG. 4B is a schematic diagram showing a cross-sectional side view of an example embodiment of the grip in the second locked position.
Figure 4A:
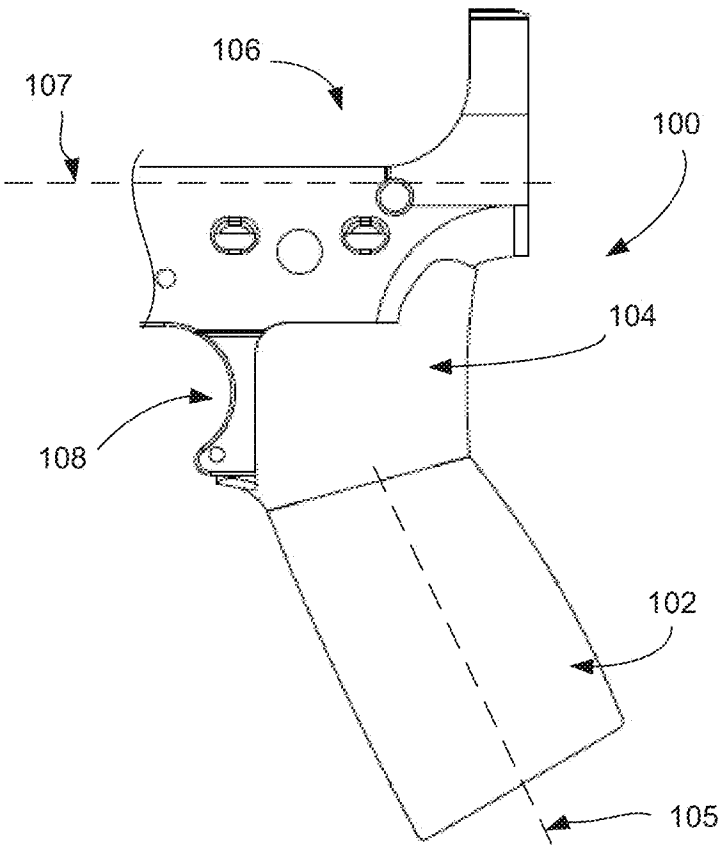
FIG. 4A is a schematic diagram showing a side view of an example embodiment of the grip in a second locked position.

FIG. 4A is a schematic diagram showing a side view of an example embodiment of the grip 100 in a second locked position after a user has released the handle 102 or allowed the handle 102 to be pushed back against the adapter 104 by the spring 112. The locking tabs 122 are no longer exposed. Again, it should be noted that the angle formed between the axis 105 of the handle 102 and the axis 107 of the rifle 106 in the first locked position of FIG. 1A is different from the angle formed between the axis 105 of the handle 102 and the axis 107 of the rifle 106 in the second locked position of FIG. 4A.

Multiple angle positions of the handle 102 with respect to the adapter 104 can be achieved by using a tilting motion rather than swivel/turn motion along an axis of the shaft 116 of the adapter 103. A locking mechanism may include bolting, latching, clamping, or squeezing the lower/upper handle to the other.

FIG. 4B is a schematic diagram showing a cross-sectional side view of an example embodiment of the grip in the second locked position. The screw 114 secures the adapter 104 to a part of the rifle 106 next to the trigger part 108. The spring loaded screw 109 secures the handle 102 against the adapter 104. The locking tabs 122 mate with pockets 123 of the handle 102 to prevent the handle 102 from rotating about an axis of the shaft 116.

In yet another embodiment, the handle 102 could be changed by flipping the lower handle top to the bottom and reattaching it to the shaft 116 for example, with a fastener.

Figure 5A:
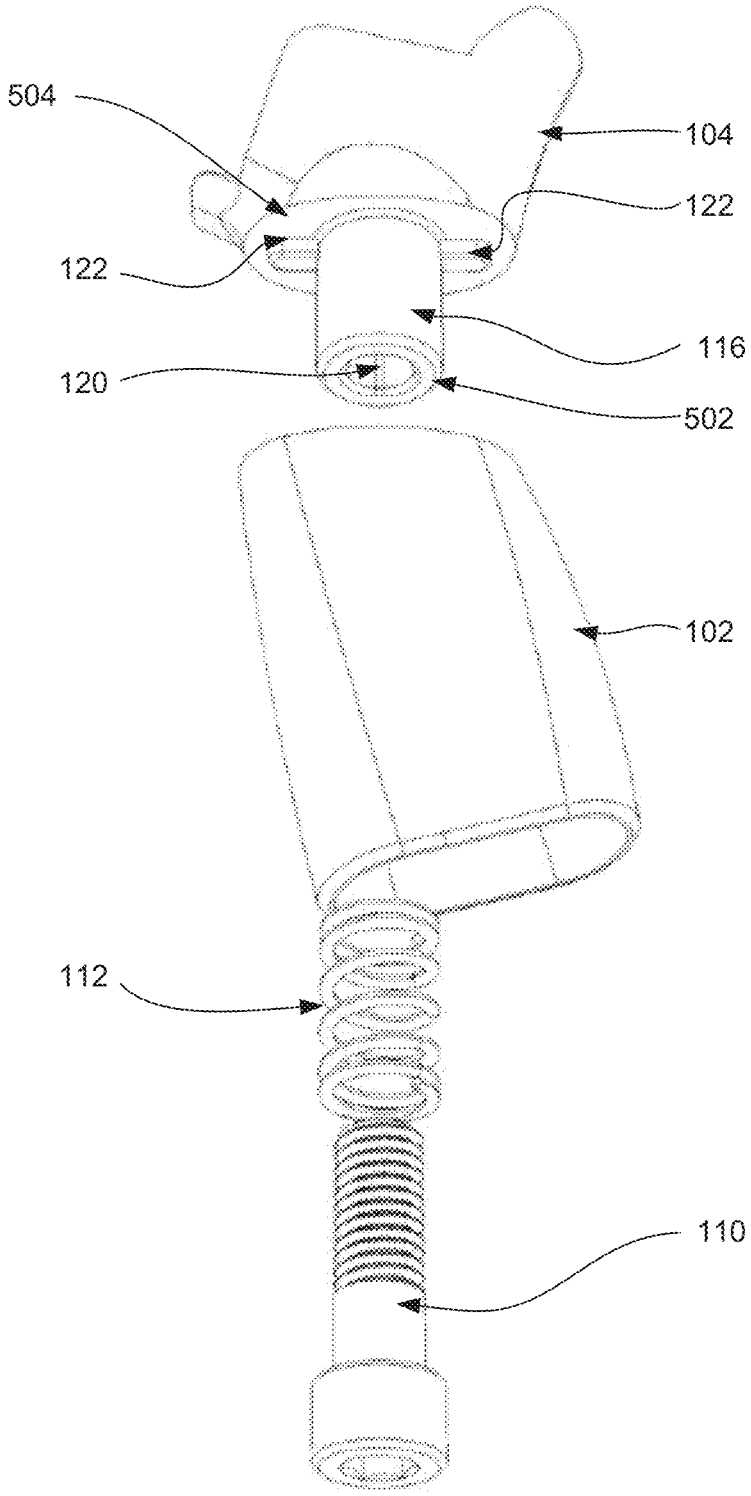
FIG. 5A is a schematic diagram showing a perspective exploded view of an example embodiment of the grip.

FIG. 5A is a schematic diagram showing a perspective exploded view of an example embodiment of the grip 100. The adapter 104 includes the shaft 116 extending from a bottom surface 504 of the adapter 104. The shaft 116 includes an opening 120 for receiving the screw 110. In one embodiment, the end of the shaft includes a tapered edge 502. The locking tabs 122 are disposed at the base of the shaft 116 extending along a radius of the shaft 116. In another embodiment, the locking tabs 122 are near an edge of the bottom surface 504 of the adapter 104. In another embodiment, the locking tabs 122 may be formed anywhere on the bottom surface 504 of the adapter 104. In another embodiment, more than one locking tabs 122 may be disposed at the base of the shaft 116. In another embodiment, the locking tabs 122 may be disposed along a surface of the shaft 116 to prevent the handle 102 from rotating when engaged with the locking tabs 122.

The screw 110 secures the handle 102 against the adapter 104. The spring 112 is disposed between the screw 110 and the adapter 104.

In one embodiment, the adapter 104 includes two locking tabs 122 opposite to one another at a base of the shaft 116 at the bottom surface 504 of the adapter 104. The locking tabs 122 may be disposed anywhere at the bottom surface 504 of the adapter 104 adjacent to the shaft 116 so that the locking tabs 122 mate with corresponding pockets 123 formed in a top surface of the handle 102.

In another embodiment, the locking tabs 122 may include notches, nodes, bumps to prevent a rotational movement of the handle 102 when corresponding pockets 123 from the handle 102 mate with the locking tabs 122.

In another embodiment, the adapter 104 includes multiple locking tabs (for example, four) disposed around the base of the shaft 116, one every 90 degrees. As such, the grip angle can move from just a backward and forward angle to a sideward angle protruding to the left or right. Four locking tabs could achieve the four positions.

Figure 5B:
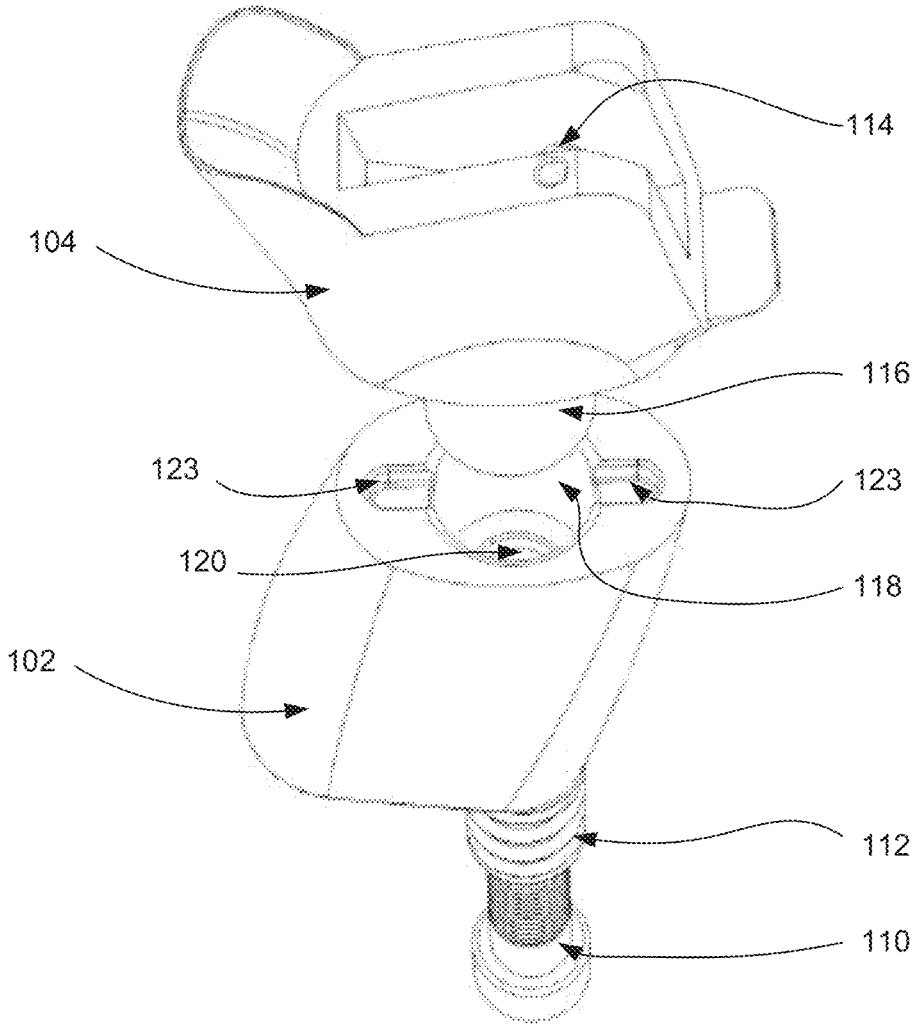
FIG. 5B is a schematic diagram showing another perspective exploded view of an example embodiment of the grip.

FIG. 5B is a schematic diagram showing another perspective exploded view of an example embodiment of the grip. The adapter 104 is coupled to a part of the rifle via the screw 114. The shaft 116 extends from the bottom surface 504 of the adapter 104. The shaft 116 mates with the cavity 118 of the handle 102. The cavity 118 includes an opening 120 at the end of the cavity 118. Pockets 123 or indentations are formed on a top surface of the handle 102 to mate with the locking tabs 122. In one embodiment, pockets 123 include a tapered edge for receiving the locking tabs 122. The pockets 123 extend from the cavity 118 along a radius of the shaft 116. In another embodiment, more than two pockets 123 may be disposed at the top surface of the handle 102. In another embodiment, the pockets 123 may be disposed anywhere along a surface of the shaft 116 to prevent the handle 102 from rotating when engaged with the locking tabs 122.

The screw 110 secures the handle 102 against the adapter 104. The spring 112 is disposed between the screw 110 and the adapter 104.

In another embodiment, instead of pulling the handle 102 to release and rotate, the handle may be able to rotate using at least two pins and/or pegs that could be used to slide back and forth to lock the assembly. The sliding of the pins/pegs may be activated via a thumb wheel, screw, or lever.

Figure 6:
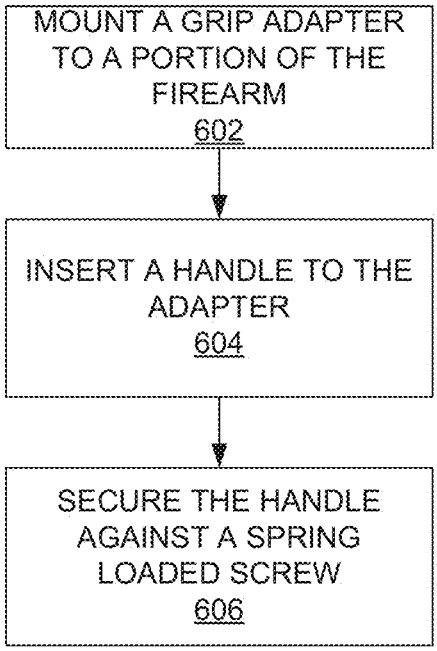
FIG. 6 is a block diagram illustrating an example embodiment of method for manufacturing the grip.

FIG. 6 is a block diagram illustrating a method of manufacturing the grip. At operation 602, a grip adapter is mounted to a lower receiver of a firearm, such as a riffle. At operation 604, a handle is inserted into the adapter. At operation 606, the handle is secured against the grip adapter with a spring loaded screw.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. A grip for an elongated fire arm, comprising:

an adapter having a top portion and a bottom portion, the top portion to receive a lower receiver of a trigger of a rifle, the bottom portion comprising at least two locking tabs adjacent to a base of a shaft extending from the bottom portion of the adapter;

a handle having a cavity disposed in an upper portion to mate with the shaft, and at least two pockets adjacent to the cavity to mate with the at least two locking tabs, the handle rotatable about an axis of the shaft when the at least two pockets are disengaged from the at least two locking tabs, the handle rotatable about the axis of the shaft between a first position and a second position, a rear wall of the handle substantially parallel to a rear wall of the lower receiver in the first position, the rear wall of the handle forming an obtuse angle with the rear wall of the lower receiver in the second position; and a spring loaded screw to secure the handle against the adapter, the at least two pockets of the handle engaged against the at least two locking tabs of the adapter in a first state of the spring loaded screw, the handle rotatable about the axis of the shaft in a second state of the spring loaded screw.

2. The rifle grip of claim 1, further comprising:

an adapter screw to secure the adapter to the gripping part of the riffle through an opening along the axis of the shaft and through an aperture disposed in the top portion of the adapter.

3. The rifle grip of claim 2, wherein the axis of the shaft is off an axis of the aperture disposed in the top portion of the adapter.

4. The rifle grip of claim 3, wherein an axis of the cavity of the handle is off a vertical axis of the handle, the handle rotatable between a first locking position and a second locking position, a wall of the handle having a first angle in reference to an axis of the rifle in the first locking position, the wall of the handle having a second angle in reference to the axis of the rifle in the second locking position.

5. The rifle grip of claim 4, wherein the first angle is substantially a right angle, the second angle is substantially an obtuse or acute angle.

6. The rifle grip of claim 1, wherein the first state comprises a resting state of the spring loaded screw, the second state comprises a compressed state of the spring loaded screw.

7. The rifle grip of claim 1, wherein the first state comprises a first compressed state of the spring loaded screw, the second state comprises a second compressed state of the spring loaded screw.

8. The rifle grip of claim 1, wherein the spring loaded screw mates with an opening along an axis of the shaft through an opening at an end of the cavity of the handle.

9. The rifle grip of claim 1, wherein the at least two locking tabs comprise tapered edges, the end of the shaft comprises a tapered shaft edge, an opening of the cavity comprises a tapered opening edge.

* * * * *